US006344831B1

(12) United States Patent
Watts, Jr.

(10) Patent No.: US 6,344,831 B1
(45) Date of Patent: Feb. 5, 2002

(54) SLOTTED CABLE LOCALIZER ANTENNA

(75) Inventor: Chester B. Watts, Jr., Annandale, VA (US)

(73) Assignee: Watts Antenna Co., Herndon, VA (US)

( * ) Notice: Subject to any disclaimer, the term of this patent is extended or adjusted under 35 U.S.C. 154(b) by 0 days.

(21) Appl. No.: 09/233,744

(22) Filed: Jan. 20, 1999

(51) Int. Cl.[7] ..... H01Q 13/10
(52) U.S. Cl. ..... 343/769; 343/771
(58) Field of Search ..... 343/769, 770, 343/771; H01Q 13/10

(56) References Cited

U.S. PATENT DOCUMENTS 3,577,197 A * 5/1971 Watts ..... 343/771
4,464,665 A * 8/1984 Watts ..... 343/771

* cited by examiner

*Primary Examiner*—Michael C. Wimer

(57) ABSTRACT

This invention relates to improvements in slotted cable runway localizer antennas for the Instrument Landing System (ILS). The antenna radiates simultaneous sum and difference patterns carrying standard ILS reference (CSB) and deflection (SBO) components of the transmitted signal. The signal components from an ILS transmitter are supplied through an rf bridge (hybrid) to both ends of the slotted cable structure. Optional isolators inserted in the coaxial feed lines improve the impedance presented to the transmitter.

6 Claims, 2 Drawing Sheets

SLOTTED CABLE LOCALIZER ANTENNA

CROSS-REFERENCE TO RELATED APPLICATIONS

"Not applicable"

STATEMENT REGARDING FEDERALLY SPONSORED RESEARCH OR DEVELOPMENT

"Not applicable"

REFERENCE TO A MICROFICHE APPENDIX

"Not applicable"

BACKGROUND OF THE INVENTION

This invention relates to improvements in slotted cable runway localizer antennas for the Instrument Landing System (ILS). It combines features of two earlier U.S. Pat. No. 3,577,197, May 4, 1971, Watts, Jr., "Slotted Cable Localizer Antenna," (Ref.1), and U.S. Pat. No. 4,464,665, Aug. 7, 1984, Watts, Jr., "Slotted Cable Antenna Structure," (Ref.2), to provide superior performance. An embodiment of this invention is described in a published paper: Watts, Jr. and Johnson, J., "Slotted Cable ILS Localizer," Proceedings of the 10th International Flight Inspection Symposium, Seattle, Wash., June, 1998, (Ref.3).

BRIEF SUMMARY OF THE INVENTION

This antenna radiates simultaneous sum and difference patterns carrying standard ILS reference (CSB) and deflection (SBO) components of the transmitted signal. The signal components from an ILS transmitter are supplied through an rf bridge (hybrid) to both ends of the slotted cable structure. Optional isolators inserted in the coaxial feed lines improve the impedance presented to the transmitter.

An object of the invention is to provide a slotted cable localizer antenna having improved efficiency and ease of construction. This is accomplished through a particular arrangement of parts, many of which are common copper plumbing fittings, together with other special parts to be described.

DETAILED DESCRIPTION OF THE INVENTION

Figure 1:
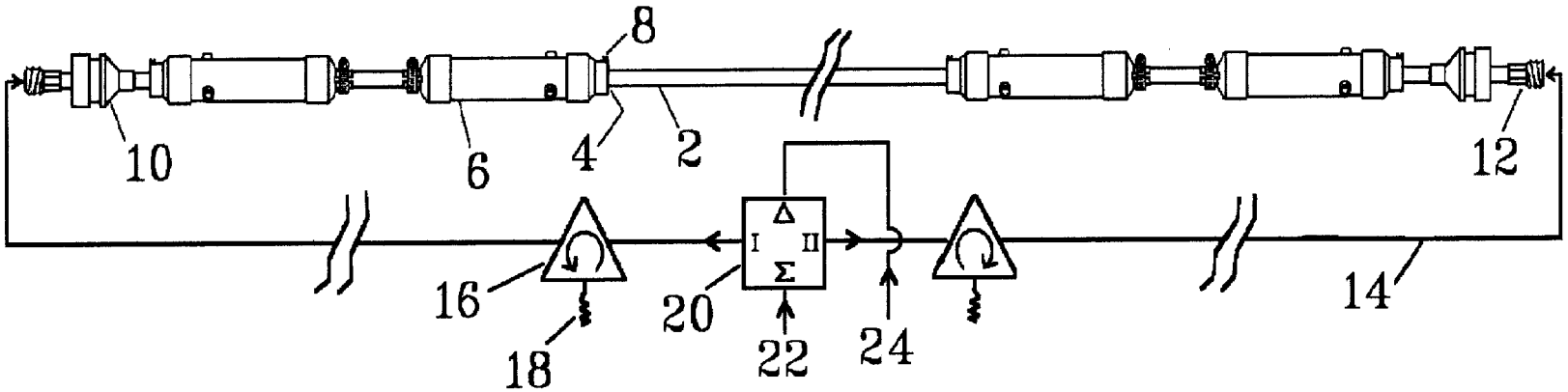
FIG. 1 is an exterior view of an embodiment of the localizer antenna, uncovered, with associated feed circuitry.

An overall view of the improved slotted cable localizer antenna, FIG. 1, shows a symmetrical arrangement of radiating slots 4, with associated parts, on a rigid transmission line 2. The break indicates that there can be a multiplicity of slots, up to as many as sixty-four or more, while maintaining symmetry, left to right. A principal feature is the extensive use of standard copper water tube and associated solder fittings, promoting both ease of construction and efficiency. The antenna is fed from both ends by a symmetrical network supplying, simultaneously, even and odd (sum and difference) rf current distributions, as described more fully in Ref.1.

Figure 2:
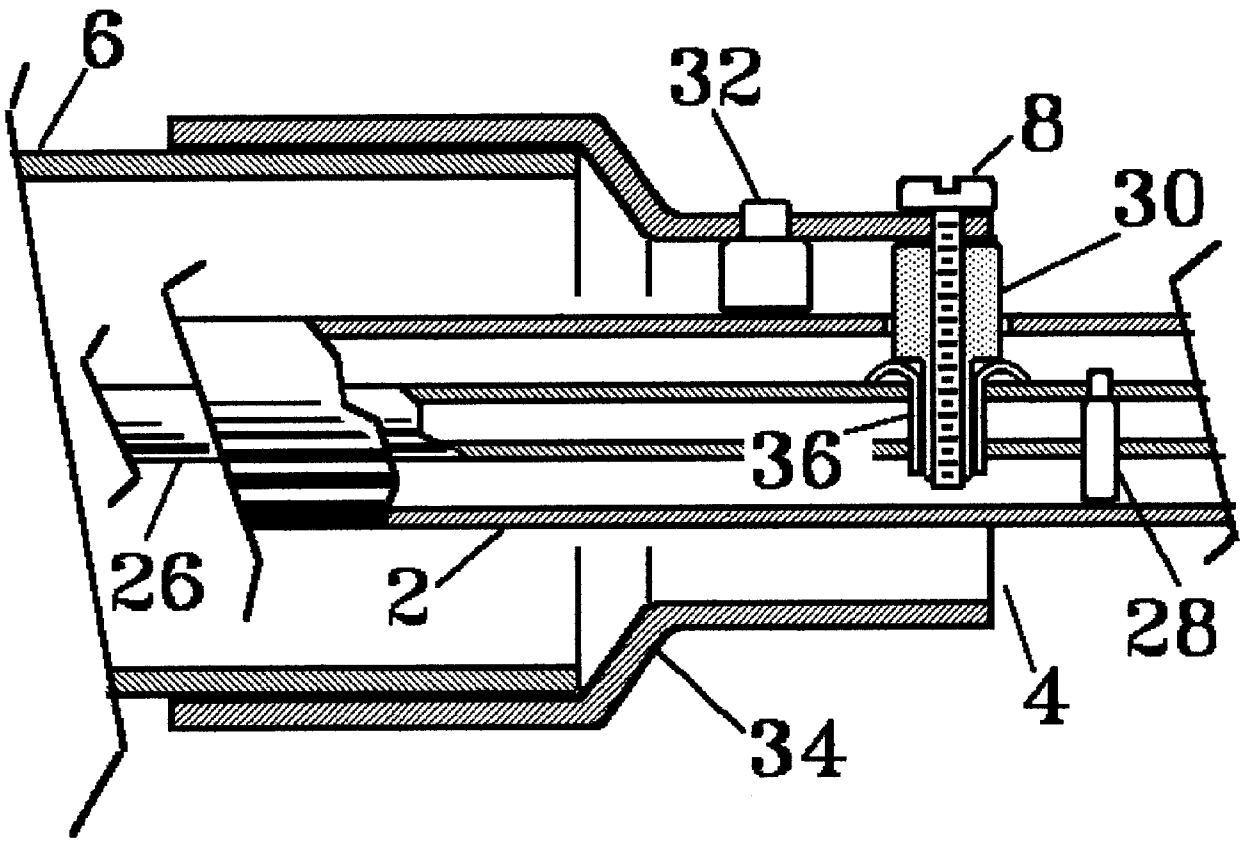
FIG. 2 is an enlarged internal view of the slot structure.

FIG. 2 is an enlarged view around a typical slot showing the associated parts more clearly. The outer conductor of the transmission line 2, which is the base upon which the antenna is built, is standard ¾" type M water tube. Inner conductor 26, is ¼" type L rigid copper water tube, supported at suitable intervals typically by teflon pin 28. Slot 4, is the gap formed between copper gap reducer 34, and outer conductor 2. Any rf current which flows on the outside of outer conductor 2, is interrupted by slot 4, but the current path is continued by the presence of gap reducer 34, soldered to the 1½" DWV copper shunt tube 6, which is conductively connected, at its other end, through shunt reducer 7, with hose clamp 9, to the outer conductor 2. The width dimension of slot 4, is stabilized by the presence of insulators typified by teflon button 32.

In order for the antenna to radiate, the currents that flow inside transmission line 2, are coupled to the outside surface by means of probe screw 8, which, with soldered eyelet 36, forms a capacitance to inner conductor 26. Teflon sleeve 30, insulates probe screw 8 from eyelet 36. The amount of current coupled out at a particular slot 4, is controlled by the length of the probe screw 8. Typically, the probe screw lengths are progressively shorter toward the ends of the antenna, producing the current amplitude taper required for low side lobes. This process is described more fully in Ref.2. The feed circuitry shown in FIG. 1 comprises equal length feed cables 14, which are fed from hybrid 20. Sum mode signal is supplied at terminal 22, while difference mode signal is supplied at terminal 24. Optional circulators 16 provide impedance matching by routing reflected power into resistive loads 18. To facilitate convenient transportation, the antenna is divided into sections joined by connectors 12, FIG. 1. Air seal 10 is provided at section ends to permit installation of a protective pressurized cylindrical cover or radome (not shown).

I claim:

1. A slotted cable antenna comprising a coaxial transmission line having an inner conductor and an outer conductor, said line being fed signals from either or both ends, a number of radiating assemblies, arranged symmetrically about a central point on said outer conductor, each of said radiating assemblies comprising a slot formed between the outer surface of said outer conductor and the inner surface of a gap reducer, said gap reducer being soldered to a length of shunt tube, the opposite end of said shunt tube being conductively connected to said outer surface of said outer conductor, a probe screw conductively connected to a shunt reducer, said probe screw projecting across said slot, through said outer conductor without conductive connection, and being capacitively coupled to said inner conductor.

2. A slotted cable antenna as in claim 1, with a feed circuit comprising a coaxial hybrid with sum and difference input terminals, with side output terminals connected to equal length feed cables, said equal length feed cables being connected to opposite ends of said slotted cable antenna.

3. A slotted cable antenna as in claim 1, with a feed circuit comprising a coaxial hybrid with sum and difference input terminals, with side output terminals connected to equal length feed cables, said equal length feed cables being connected to opposite ends of said slotted cable antenna, wherein impedance matching isolators are inserted symmetrically in the outputs of said coaxial hybrid.

4. An antenna as in claim 1, wherein the length of said probe screw is cut to be symmetrically shorter toward the ends of said antenna, thereby reducing minor lobes.

5. An antenna as in claim 1, wherein said antenna is divided in sections, each of said sections being equipped at each end with a coaxial rf connector and an O-ring seal, thereby permitting installation of an air-tight cover, or radome, over said section.

6. An antenna as in claim 1, wherein said outer conductor is constructed of plumbing standard ¾" type M copper water tube, said inner conductor is constructed of ¼" type L copper water tube, and said shunt tube is constructed of 1½" type DWV copper water tube.

* * * * *